United States Patent [19]

Smith et al.

[11] 3,994,350

[45] Nov. 30, 1976

[54] ROTARY DRILLING RIG

[75] Inventors: Jack D. Smith, Mesquite; Ray M. Mitchart, Dallas, both of Tex.

[73] Assignee: Gardner-Denver Company, Dallas, Tex.

[22] Filed: Oct. 14, 1975

[21] Appl. No.: 621,936

[52] U.S. Cl. ..... 175/85; 173/147

[51] Int. Cl.[2] ..... E21B 19/00; E21C 5/00

[58] Field of Search ..... 175/85, 170, 195; 173/28, 147, 160; 214/2.5

[56] References Cited

UNITED STATES PATENTS

| | | | |
|---|---|---|---|
| 2,849,212 | 8/1958 | Robbins | 175/85 |
| 3,721,305 | 3/1973 | Mayer et al. | 173/147 |
| 3,828,943 | 8/1974 | Simon | 175/85 |
| 3,867,989 | 2/1975 | Hisey et al. | 173/147 |
| 3,920,087 | 11/1975 | Hisey et al. | 175/85 |
| 3,929,235 | 12/1975 | Howard et al. | 175/85 |

*Primary Examiner*—James A. Leppink
*Attorney, Agent, or Firm*—Michael E. Martin

[57] ABSTRACT

A rotary drill rig includes an elongated mast, a pulldown head disposed for linear traversal along the mast and connected to mechanism for effecting pulldown and hoisting movements on a drill string, and a rotary drive unit adapted to be connected to the pulldown head for unitary movement therewith to form a rotary top drive drilling head. The rotary drive unit may be detached from the pulldown head and disposed at the lower end of the mast for performing joint breakout operations on the sectional drill string members and for performing drilling operations as a rotary table drive. A pair of parallel tracks are disposed on the mast for guiding the pulldown head and the rotary drive unit. The tracks are turned inward into the mast near the top end thereof to provide for parking the pulldown head out of the way of a block and tackle which may be used to raise relatively long drill strings from the drill hole.

20 Claims, 19 Drawing Figures

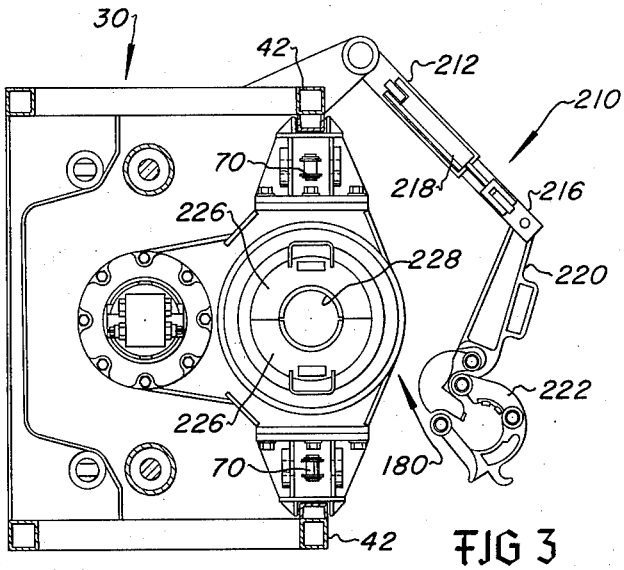
FIG 3
FIG 2
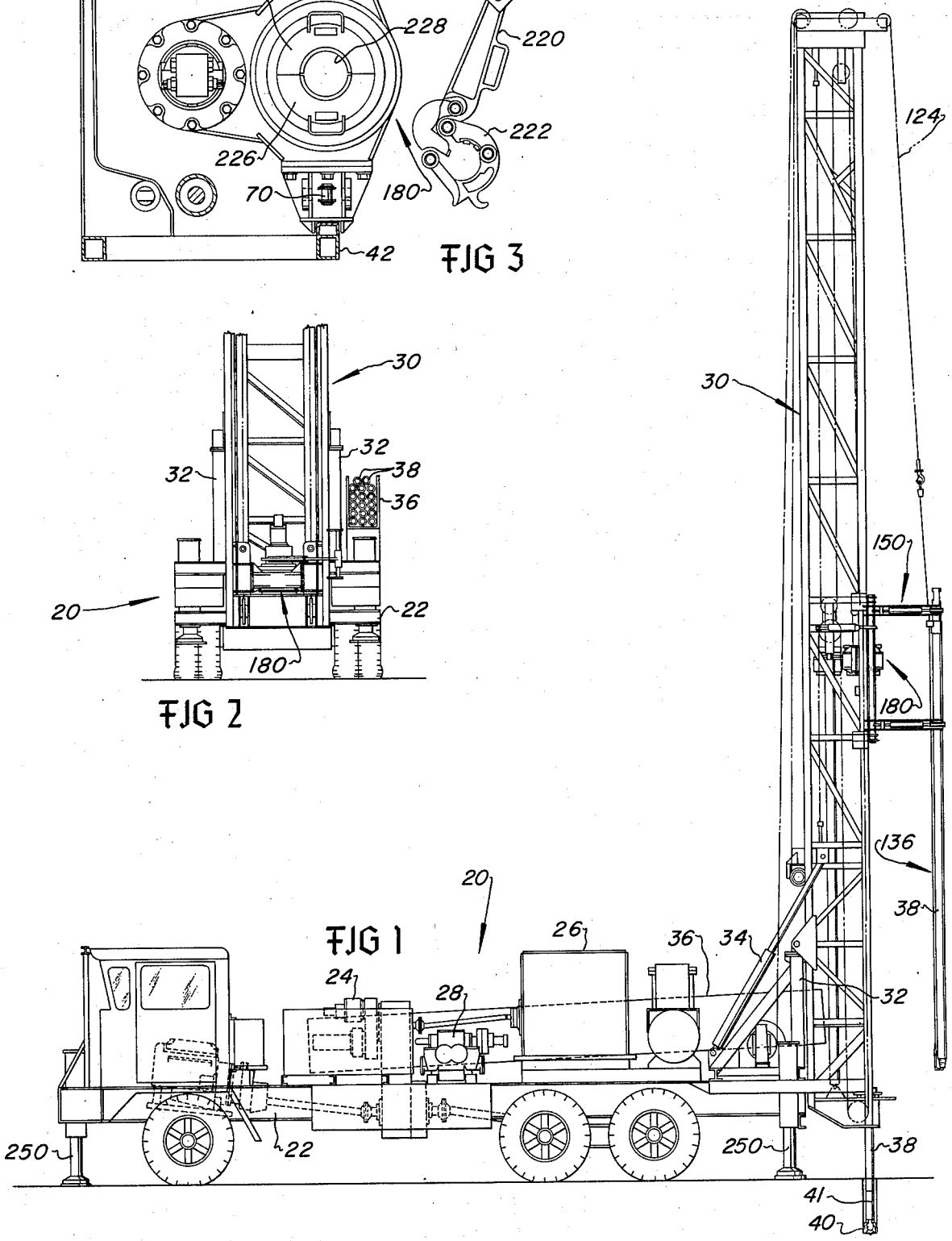
FIG 1

ROTARY DRILLING RIG

BACKGROUND OF THE INVENTION

In the art of earth drilling apparatus the efficient handling of the elongated sectional drill pipe members has been a problem of longstanding. In so-called rotary drilling the type of apparatus known in the art as a top drive has been developed to overcome certain problems associated with rotary drive devices which are mounted at the base of the drill rig, and otherwise known as rotary table drives. In top drive rigs the drill string rotating mechanism usually comprises an integral part of a head which is connected to the upper end of the drill string and is mounted for reciprocal traversal of a mast or drill tower to feed the drill string into the drill hole being formed and to hoist the drill string out of the drill hole. Rotary top drives eliminate the need for the special elongated drive member or kelly normally used with rotary table drive arrangements and thereby simplify the process of adding sectional drill pipe members with respect to the drill string. For example, when adding drill pipe to the drill string it is not necessary to first remove a kelly from the string each time a sectional pipe member is connected to the drill string, and the problem of a hole cave-in is avoided because the lower end of the drill string does not have to be raised a substantial distance off the bottom of the hole before a section of pipe is added. Moreover, in some earth formations it is often desirable to rotate the drill string while removing the same from the drill hole and such operation is not possible or at least becomes more complicated with rotary table type drive mechanisms.

The rotary table type of drive arrangement does offer certain advantages, namely, rotary table drive mechanisms are usually adapted to be used as a wrench for breaking out or disconnecting the joints between sectional pipe members. Furthermore, rotary table drives are more desirable for use on drilling rigs for drilling holes of substantial depth because greater rotational effort or torque is required and it is desirable to place the rotary drive mechanism on the base of the mast or on a lower portion thereof so as not to impose large twisting forces plus the weight of the rotary drive mechanism itself on the upper portions of the mast or tower.

Because of the abovementioned problems associated with conventional top drive and rotary table drive arrangements prior art drilling rigs have not been a versatile or as efficient as is desired, particularly rigs built for drilling holes within a wide range of hole depths.

SUMMARY OF THE INVENTION

The present invention is directed to an improved earth drilling rig which is provided with a rotary drive mechanism comprising a unit which is adapted to be drivingly connected to the upper end of a drill string, to traverse the mast or drill tower to operate as a so-called top drive arrangement for drilling, and to be disposed on the lower end of the mast to operate as a rotary table type drive for drilling and for breaking out the threaded joint connections between sectional members of the drill string. The improved drill rig of the present invention also includes a drill string coupling member mounted on a head which is connected to pulldown and hoisting mechanism mounted in the mast. The head is adapted to be connected to the rotary drive unit for effecting movement of the drive unit along the mast and for providing a coupling to transmit rotation from the drive unit to the drill string.

The drilling rig of the present invention is also provided with a mast and associated pulldown and hoisting mechanism which is adapted to park the swivel and head in a position which will permit hoisting long strings of drill pipe from the drill hole by block and tackle means disposed on the mast and suitable for being operated in combination with the rotary drive unit to remove sectional drill pipe members from the drill string in a more rapid manner.

The drilling rig of the present invention is further provided with an improved positioning mechanism mounted on the rig mast and adapted for remote control to position a section of drill pipe in line with the centerline of the drill string and to be operated as a holding wrench for breaking out the threaded connection between a section of drill pipe and the swivel member. The positioning mechanism is also provided with improved fluid actuated pipe gripping means which minimizes the chance of unwanted release of a section of drill pipe. A further advantage of the positioning mechanism is that it may be used as a holding wrench for breaking loose drill pipe connections with the pulldown head.

The drilling rig of the present invention includes apparatus in combination which provides for improved handling of sectional drill pipe members to enable faster and more effective drilling operations to be carried out for drilling holes within a considerable range of hole depth. The drilling rig of the present invention is provided with apparatus which enables the rig to be operated as a top drive type drill or as a rotary table type drill, as desired, whereby advantages of both types of apparatus may be enjoyed. Furthermore, the novel combination of elements in the drill rig of the present invention provides a more versatile and superior earth drilling apparatus than has been heretofore known.

BRIEF DESCRIPTION OF THE DRAWINGS

FIG. 1 is a longitudinal side elevation of a portable earth drilling rig in accordance with the present invention;

FIG. 2 is a partial end view of the drill rig of FIG. 1;

FIG. 3 is a plan view showing the rotary drive unit and a joint disconnecting wrench used with the drill rig of the present invention;

DESCRIPTION OF THE PREFERRED EMBODIMENT

Figure 5:
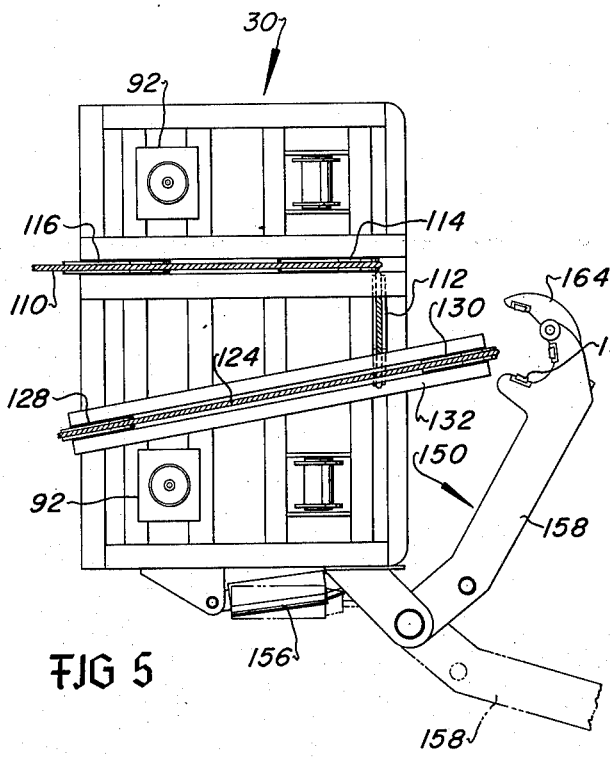
FIG. 5 is a view taken from the line 5—5 of FIG. 4.

Referring to FIGS. 1 and 2 of the drawings the rotary earth drilling rig of the present invention is generally designated by the numeral 20. The drill rig 20 includes a self-propelled wheeled carrier 22 upon which is mounted suitable engine means and drive mechanism for driving suitable power transmission means such as hydraulic pumps 24 and the like. The carrier 22 also has disposed thereon an air compressor housed within an enclosure 26 and a high pressure pump 28 for providing chip evacuating fluids as needed. Such equipment as aforementioned is conventional on rotary earth drilling rigs and will therefore not be described in further detail.

The drill rig 20 is also characterized by an elongated mast, generally designated by the numeral 30, which is mounted on a pair of spaced apart supports 32 for movement from a substantially horizontal transport position to the working position shown in FIG. 1. Hydraulic cylinders 34, one shown in FIG. 1, are connected to the mast 30 and the carrier 22 for erecting and lowering the mast in a conventional manner. As shown in FIGS. 1 and 2 the drill rig 20 also includes an elongated tray 36 disposed on the carrier 22 for holding a plurality of elongated sectional drilling members comprising hollow tubes or pipes 38 which may be coupled in end-to-end relationship in a known way to form a drill string together with a bit 40, shown in FIG. 1.

Figure 6:
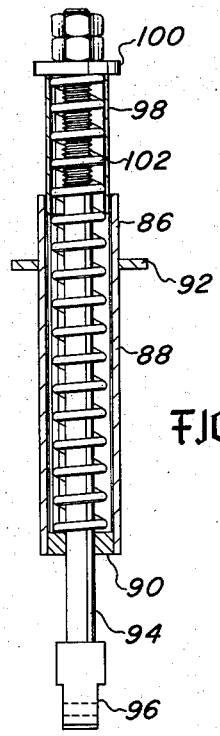
FIG. 6 is a detail view of one of the pulldown chain tensioning assemblies.
Figure 4:
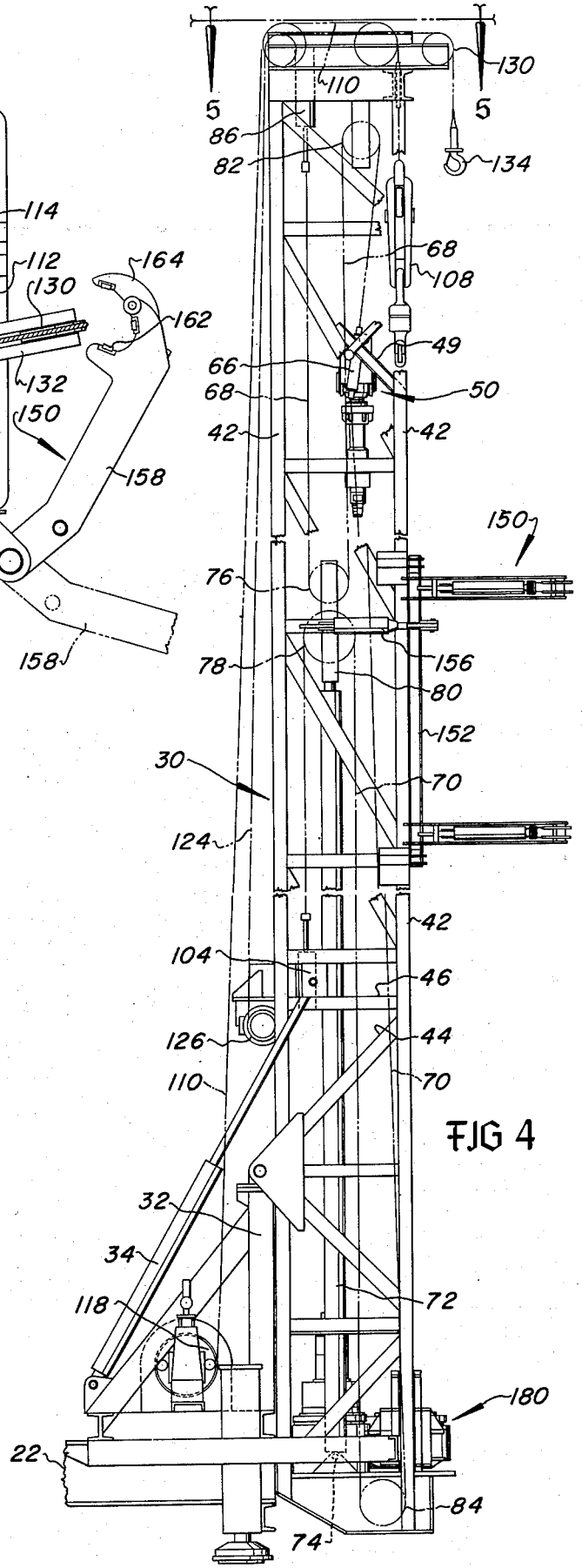
FIG. 4 is a side elevation of the mast of the drill rig of FIG. 1 with portions broken away.
Figure 8:
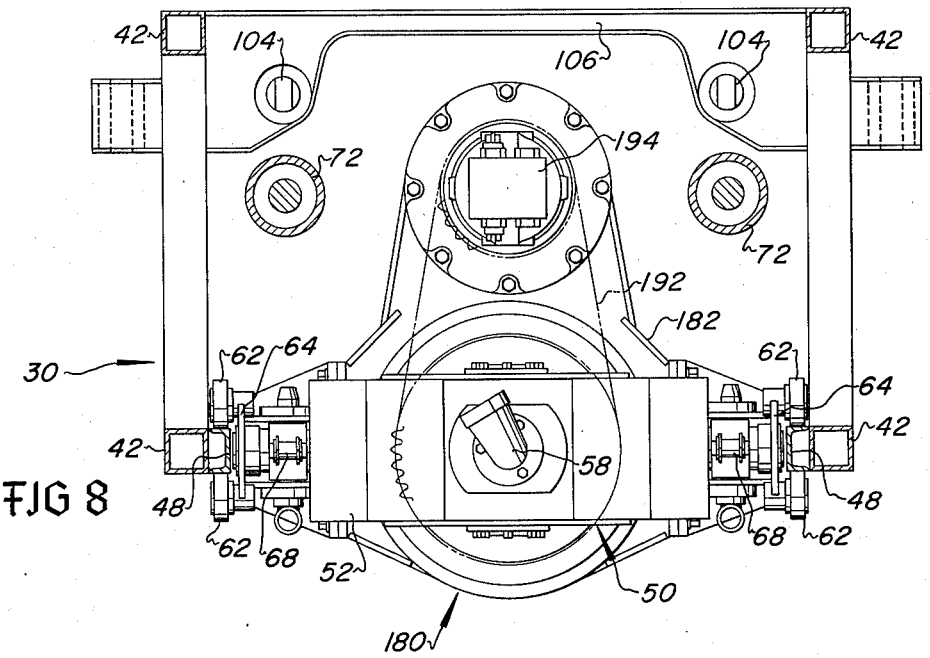
FIG. 8 is a view taken from the line 8—8 of FIG. 7.
Figure 7:
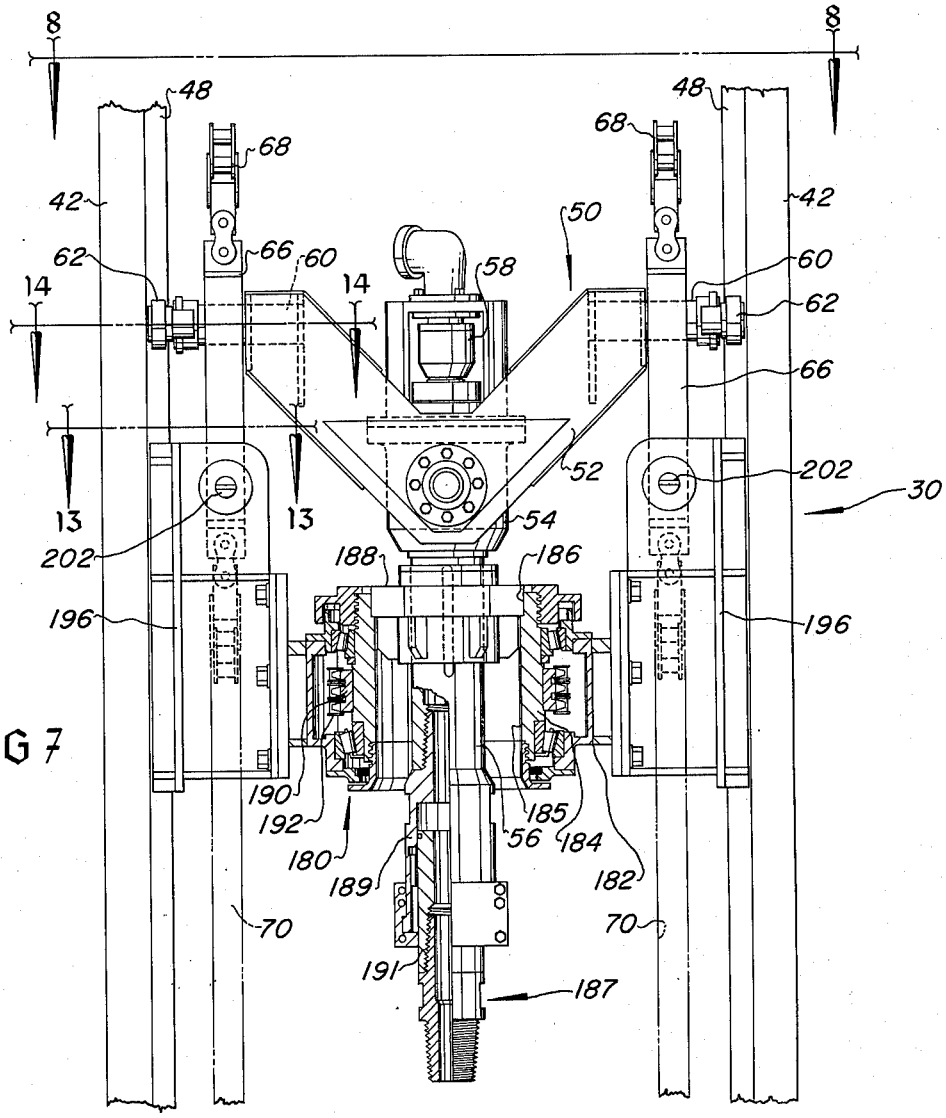
FIG. 7 is a front elevation, partially sectioned of the pulldown head and rotary drive unit connected together.

Referring to FIGS. 4 through 8, the mast 30 is characterized by conventional built-up truss type construction to form an elongated boxlike frame. Longitudinal beam members 42 are interconnected by suitable braces 44 and 46. One side, referred to as the front of the mast is open to permit the traversal therealong of a pulldown head and rotary drive unit to be described in further detail herein. Referring particularly to FIGS. 7 and 8 the mast 30 also includes a pair of spaced apart and parallel tracks 48 formed by channel members fastened to and running longitudinally along the members 42. Near the upper end of the mast 30 the tracks include portions 49 which turn inward into the mast at an angle with respect to the track portions 48 and the members 42, as shown in FIG. 4.

Figure 14:
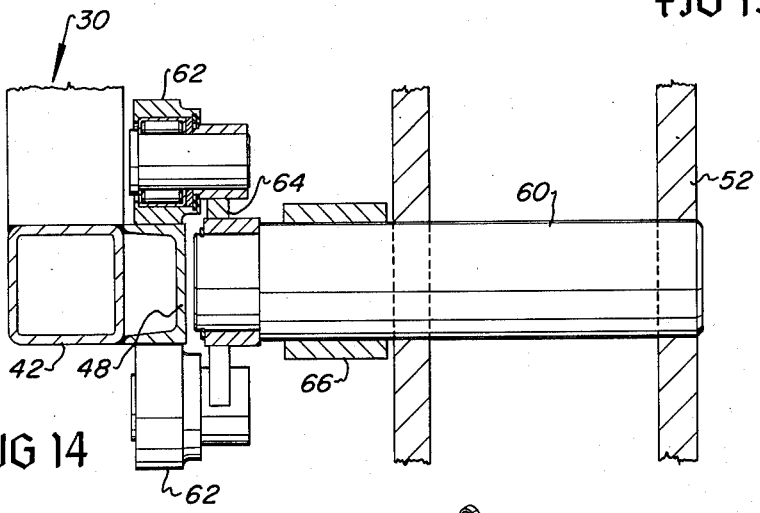
FIG. 14 is a view taken along line 14—14 of FIG. 7.

The drill rig 20 includes a pulldown head generally designated by numeral 50 which is disposed on the mast to be guided along the tracks 48. As shown in FIGS. 7, 8 and 14 the pulldown head comprises a somewhat V-shaped frame member 52 upon which is mounted a swivel unit 54. The swivel unit 54 rotatably supports a relatively short cylindrical sub 56 and a rotary coupling 58 adapted to be connected to suitable conduit means, not shown, for conducting drill cuttings evacuation fluid through the swivel unit and to the drill string. The frame member 52 includes two oppositely projecting trunnions 60 mounted thereon. As shown by way of example in FIG. 14 each trunnion 60 supports a pair of spaced apart guide rollers 62 mounted on suitable supports 64 which are pivotally mounted on the ends of the trunnions. The rollers 62 are engageable with opposite sides of the tracks for guiding the head 50 along the mast 30. The trunnions 60 project through and are connected to vertically disposed members 66 which are connected at each end to flexible members in the form of roller type chains 68 and 70 which form part of a pulldown and hoisting mechanism for the head 50.

Figure 9:
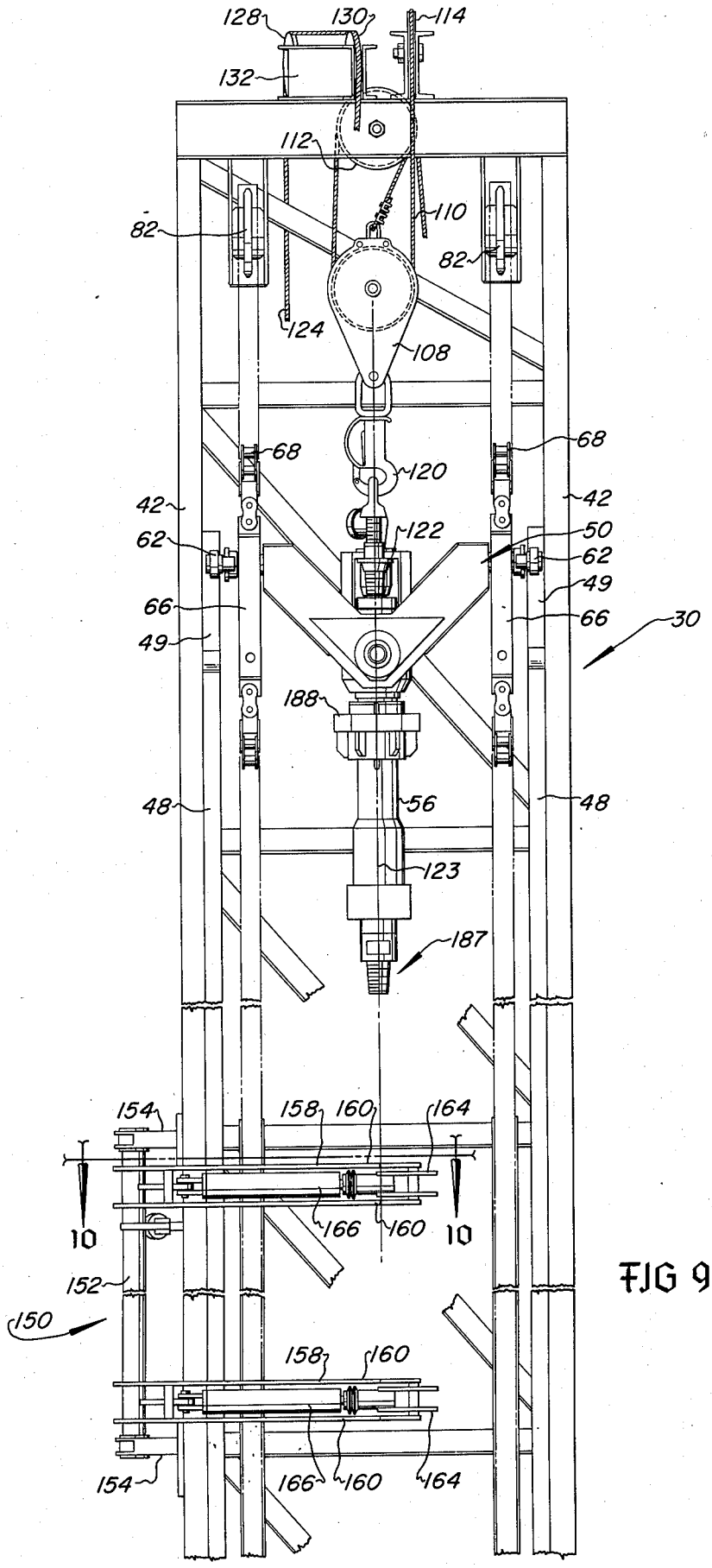
FIG. 9 is an elevation view of the upper part of the mast with the pulldown head in the retracted or parked position.
Figure 11:
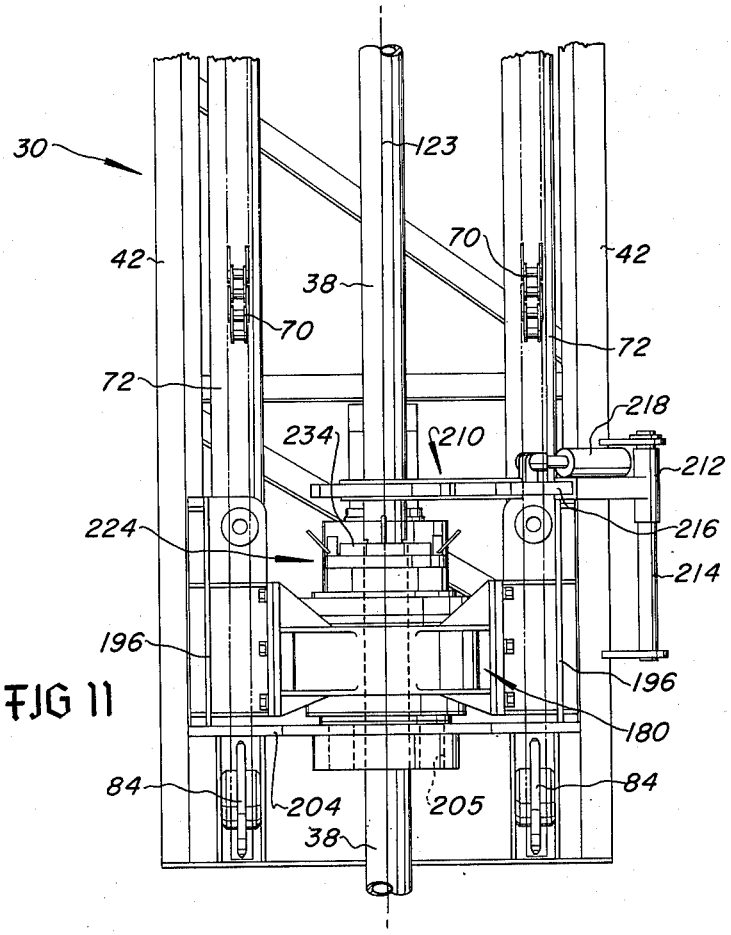
FIG. 11 is an elevation view of the lower part of the mast with the rotary drive unit disposed on the mast deck.

Referring to FIGS. 4, 9, and 11 the pulldown mechanism of the drill rig 20 is also characterized by a pair of elongated upstanding hydraulic cylinders 72 which are connected to the lower end of the mast at 74. The cylinders 72 each include sprockets 76 and 78 mounted on the end of the cylinder piston rods 80. Sprockets 82 and 84 are also rotatably mounted on the upper and lower ends of the mast 30, respectively. As shown in FIG. 4 the chains 68 are connected at one end to the members 66, are trained around the sprockets 82 and 76, and are connected at their opposite ends to chain tensioning devices generally designated by the numeral 86.

Referring to FIG. 6 one of the chain tensioning devices 86 is shown in detail and includes an elongated tube 88 having a transverse end plate 90 and a mounting plate 92. A partially threaded rod 94 is disposed within the tube 88 and is adapted at one end 96 to be connected to the chain 68. A slightly smaller tube 98 is retained on the rod 94 for telescoping movement into the tube 88 which movement is limited by a transverse plate 100 on the end of tube 98. A coil spring 102 is held captive between the tubes 88 and 98 and around the rod 94. The spring 102 is operable to yieldably hold the chain 68 taught under all operating conditions thereof.

The chains 70 are connected to the lower ends of members 66, are trained around the sheaves 84 and 78, and are connected at their opposite ends to respective chain tensioning devices 104. The chain tensioning devices 104 are similar in construction to the devices 86 and are suitably secured to a transverse bulkhead 102 in the mast 30, as shown in FIG. 8.

A suitable hydraulic circuit including controls therefor is connected to the cylinders 72 for introducing hydraulic fluid thereto to extend the piston rods 80 to effect operation of the chains 70 to pull the head 50 down the mast 30 to thereby exert a controlled downthrust or pulldown on a drill string connected to the head. Accordingly, retraction of the piston rods 80 will effect a raising of the head 50 up the mast and, if desired, into a retracted and parked position, as shown in FIGS. 4 and 9, whereby the head will be clear of the centerline or drilling axis of the drill string.

Referring to FIGS. 4, 5, and 9 the drill rig 20 includes means for lowering and hoisting the drill string and sectional drill pipe members and comprising a traveling block 108 which is suspended by a cable 110. The cable 110 is trained over sheaves 112, 114, and 116 and is secured to the drum of a power operated winch 118 disposed on the main frame of the carrier 22. A hook 120 is suspended from the block 108 and a threaded plug 122 is in turn suspended from the hook and is adapted for screwing into and out of the internally threaded upper end of a section of drill pipe. The block 108 is disposed on the mast 30 to hang substantially in line with the centerline or normal drilling axis 123 of the drill string shown in FIGS. 9 and 10.

Figure 15:
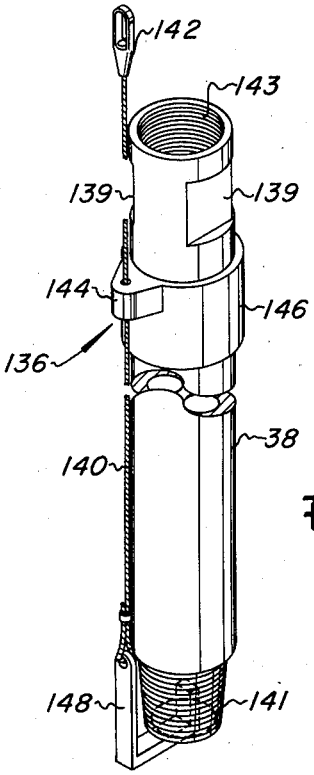
FIG. 15 is a perspective view of a typical sectional drill pipe member used with the drill rig of the present invention.

An auxiliary hoist apparatus is also disposed on the mast 30 and comprises a hoist cable 124 connected to a winch 126 and trained over sheaves 128 and 130 which are mounted on a support 132 on top of the mast. The support 132 projects out over the front of the mast to provide clearance between section of drill pipe hung from the cable 124 and the head 50 when the latter is not parked in the position of FIG. 4. The free end of the cable 124 has a hook 134 disposed thereon for connecting the cable to a sling 136, shown in FIG. 15, or to another suitable pipe pickup device. Referring to FIG. 15 one of the sectional drill pipe members 38 is shown with the sling 136 comprising a cable 140 with a shackle 142 at the top end thereof for connection to the auxiliary hoist cable hook 134. The cable 140 passes through a hole in the arm 144 of a tubular sleeve 146 which may be disposed over the upper end of the section of pipe 38 in a close fitting but freely slidable relationship thereto. A hook 148 at the lower end of the cable 140 may be disposed in the bore of the pipe 38 as shown. When the cable 140 is under tension the sleeve 146 becomes frictionally engaged with the section of pipe 38 whereby the auxiliary hoist may be operated to pick up a section of pipe out of the tray 36 and raise the section of pipe to a substantially vertical position whereupon the section of pipe may be further handled by apparatus to be described herein. When the section of pipe is in a substantially vertical position and tension on the cable 140 is released the sleeve 145 will slide down the section of pipe 38 so that the sleeve and the hook 148 can be removed from the pipe.

Figure 10:
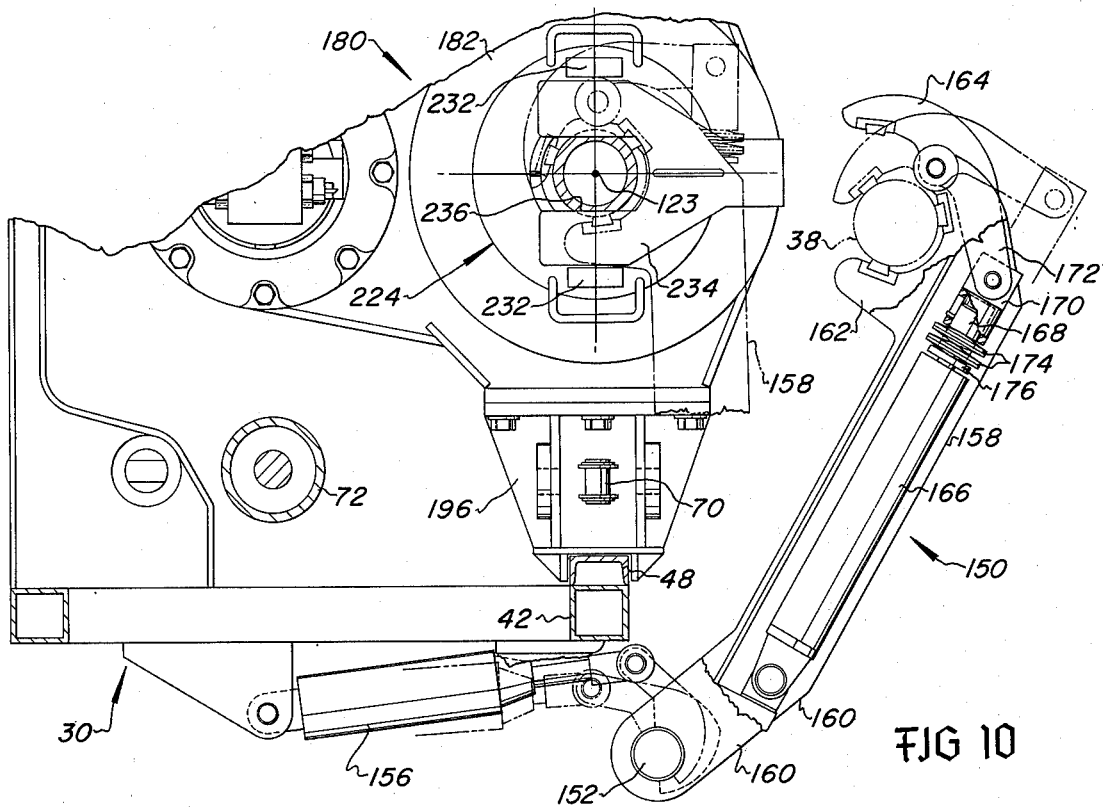
FIG. 10 is a view taken generally along the line 10—10 of FIG. 9.

An improved drill pipe handling and positioning mechanism is shown in detail in FIGS. 9 and 10 and generally designated by the numeral 150. The positioning mechanism 150 is characterized by a pair of spaced apart brackets 154 disposed on the mast 30 and supporting a shaft 152 for pivotal movement about an axis substantially parallel to the axis 123. A hydraulic cylinder and piston actuator 156 is suitably connected to the shaft 152 and to the mast 30. The positioning mechanism 150 is further characterized by a pair of spaced apart arms 158 each of which comprises a pair of plate members 160 spaced from each other and suitably connected together and fixed to the shaft 152. The arms 158 are aligned with each other and each arm includes a fixed jaw portion 162 and a pivotally mounted jaw member 164. A hydraulic cylinder actuator 166 is disposed on each of the arms 158 and includes a piston rod 168. The end of the piston rod 168 of each cylinder 166 is slidably disposed in a tubular sleeve 170 which is connected to an arm 172 of the jaw member 164. A plurality of conical disk springs 174 are disposed around the piston rod 168 and are retained between the sleeve 170 and a transverse shoulder 176 on the piston rod.

The cylinders 166 on the arms 158 are operable to actuate the jaws 164 to clamp and hold a sectional drill pipe member 38 as shown in FIG. 1. When the cylinders 166 are actuated to clamp a drill pipe member the conical disk springs 174 are deflected and thereby exert a force on the jaws 164 tending to keep them closed. Accordingly, even if there is some unwanted relaxation of the hydraulic fluid pressure in the cylinders 166 the springs 174 will tend to cause a substantial force to be exerted on the jaws 164 to hold a section of drill pipe therein. The arms 158 may be swung by the cylinder 156 between a position in line with the drilling axis 123 of the drill string, as shown in phantom in FIG. 10, and one or more retracted positions as shown in FIGS. 1 and 5. The arms 158 may be positioned substantially directly beneath the sheave 130 of the auxiliary hoisting tackle for receiving a section of drill pipe between the jaws 162 and 164. Suitable controls of a conventional type, not shown, may be used to actuate the cylinder 156 and the cylinder actuators 166.

An important part of the present invention comprises the particular arrangement of a rotary drive unit shown in FIGS. 4, 7, 8, and 11 and generally designated by the numeral 180. The drive unit 180 comprises a housing 182 which is shown in section in FIG. 7 to illustrate a drive member 184 rotatably mounted within the housing on suitable bearings. The drive member 184 is in the form of a hollow tube having a relatively large bore 185 and a polygonal recess 186 in which is removably disposed an interfitting drive member comprising a collar 188. The drive member 184 includes a sprocket 190 which is engaged with an endless chain 192 which in turn is drivenly connected to a reversible hydraulic motor 194 mounted on the housing 182 as shown in FIG. 8. The collar 188 is fixed to the sub 56 for rotatably driving the sub in response to rotation of the drive member 184. The sub 56 is threadedly connected to a coupling 187 which includes members 189 and 191 provided with interfitting splines which permit limited axial movement between the members to allow for the necessary axial movement between the coupling 187 and a sectional drill pipe member, not shown, when said member is being threadedly coupled or uncoupled with respect to the head 50.

Figure 13:
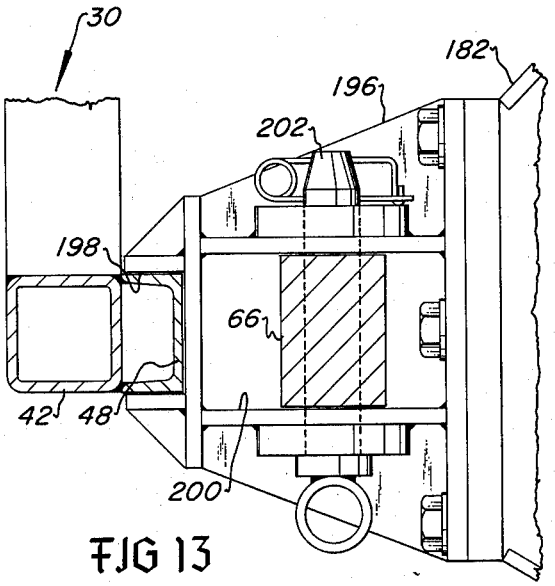
FIG. 13 is a view taken along line 13—13 of FIG. 7.

The housing 182 is removably fastened to a pair of oppositely extending guide shoes 196 which are adapted to retain the drive unit 180 between the tracks 48 for traversing movement therealong. In FIG. 13 one of the guide shoes 196 is shown in plan view and is formed to have a recess 198 in which the track 48 is disposed whereby the guide shoe may be guided along the track. The guide shoes 196 also include a vertical opening 200 through which the pulldown chains 70 may run. Removable pins 202 are operable to interconnect the members 66 with the drive unit 180, as shown in FIGS. 7 and 13, whereby the drive unit may be operated to traverse the mast 30 with the head 50 for operation on the drill rig 20 as a so-called rotary top drive, that is the driving of the drill string substantially from the upper or top end thereof. Conversely, the drive unit 180 may be lowered to a transverse deck member 204 which is generally at the lower end of the mast 30 as shown in FIG. 11 and left there by removal of the pins 202 whereby the head 50 may be operated to traverse the mast 30 independently of the drive unit. Accordingly, depending on the disposition of the drive unit 180 the drill rig 20 may be operated to drive a drill string from substantially the upper or top end thereof as will be appreciated from further description of the drive unit hereinbelow, or with the drive unit disposed on the deck 204 it may be used as a so-called rotary table drive.

The drill rig 20 includes further elements which together with the above described apparatus provides for improving the handling of sectional drill string members and the overall efficiency of operation to drill holes under various drilling conditions. Referring to FIGS. 3 and 11, the drill rig 20 includes a sectional drill pipe joint breakout wrench 210 which comprises an arm 212 mounted on a cylindrical column 214 fixed to the side of the mast 30 near the lower end thereof. The wrench arm 212 is adapted to pivot on and move longitudinally along the column 214. The arm 212 supports a member 216 for telescoping movement with respect to the arm and controlled by a hydraulic cylinder 218. The member 216 pivotally supports a lever arm 220 of a set of wrench jaws of a pipe tong 222 of a well known type. The pipe tong 222 includes a plurality of hinged jaws which are adapted to be closed around the outside wall surface of the cylindrical drill pipe to tightly grip the pipe in response to extension of the member 216 whereby the pipe may be rotated sufficiently to break loose the threaded connection with a section of drill pipe coupled thereto.

Figure 12:
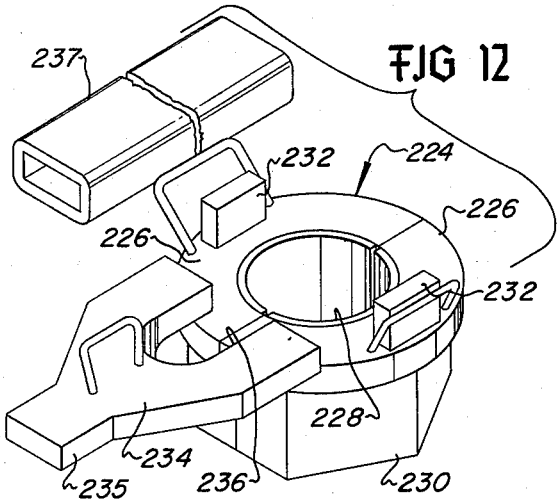
FIG. 12 is a perspective view of the guide bushing and a holding wrench used with the rotary drive unit.

Referring to FIGS. 3 and 12 there is shown a collar or bushing generally designated by the numeral 224. The bushing 224 is formed of two identical parts 226 which, when assembled or placed together as shown, form a central bore 228 and a depending polygonal portion 230 which is proportioned to be inserted in the recess 186 in the rotary drive member 184 in place of the collar 188 when the drive unit 180 is disposed on the deck 204 as shown in FIGS. 3 and 11. The bushing 224 includes a pair of spaced apart tabs 232 which guide and retain a removable pipe holding wrench 234, shown in FIG. 12. The wrench 234 includes a handle portion 235 which is adapted to receive one end of a tubular handle extension member 237, shown in FIG. 12, for use with the wrench as explained hereinbelow. The holding wrench 234 is characterized by an open ended slot 236 to provide for inserting the wrench into cooperating flat sided recesses 139 which are formed in the outside wall of the sections of drill pipe 38, as shown in FIG. 15. The sectional drill pipe members 38 may be of the conventional hollow steel tube type having an externally threaded lower end or pin 141 and an internally threaded upper end or box 143.

The operations to add sectional drill pipe members to the drill string for drilling and to remove drill pipe members from the drill string will now be described with reference to drawing FIGS. 16 through 19.

Figures 16, 17, 18, 19:
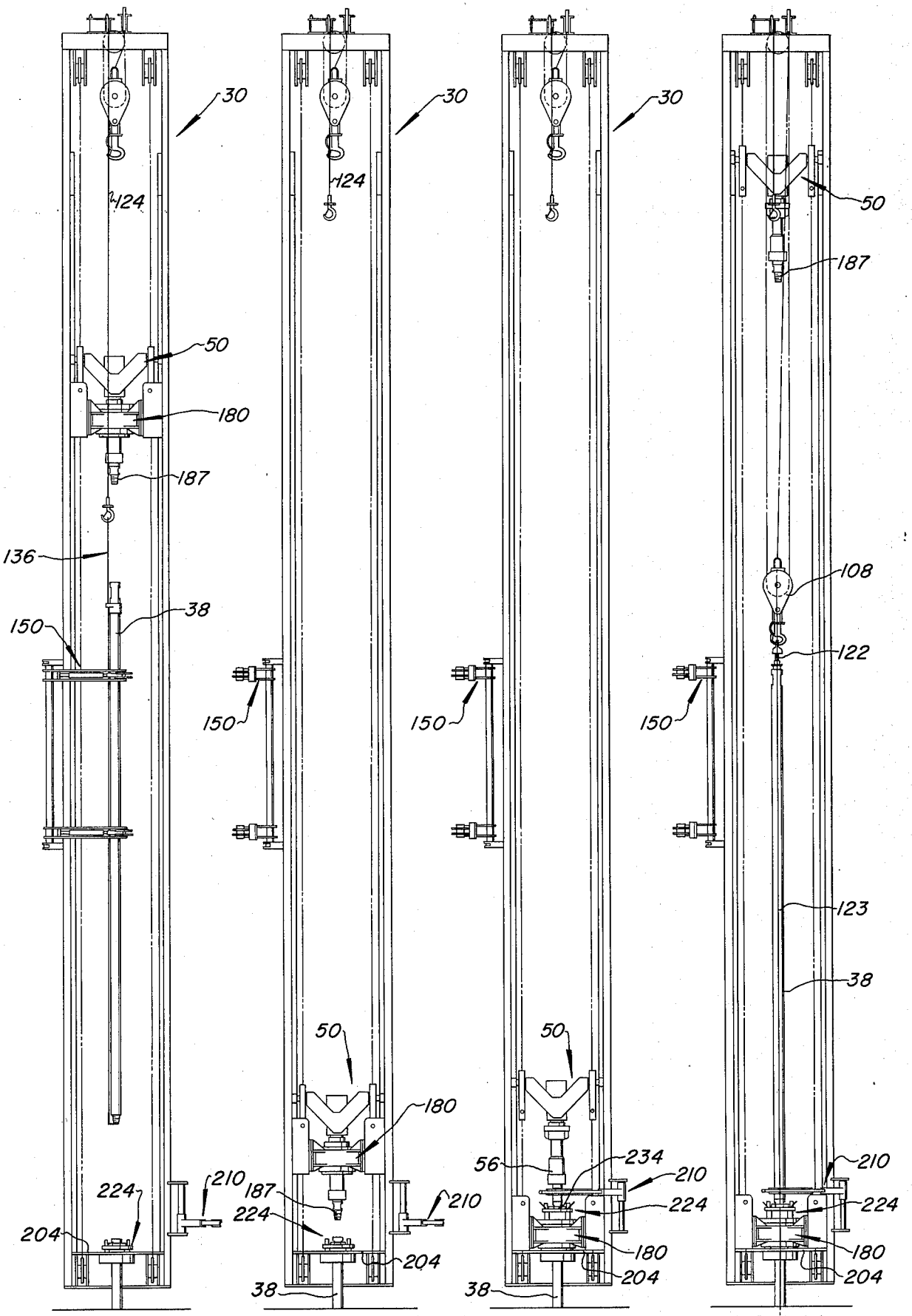
FIGS. 16 through 19 are schematic front elevations of the mast showing the drill rig of the present invention in various operating modes.

Preparatory to commencement of drilling operations the rig 20 will be moved to the drilling location, jacks 250 will be lowered to stabilize and support the rig and the mast 30 will be raised to the position shown in FIG. 1. The head 50 and the rotary drive unit 180 will be coupled together and raised up the mast sufficiently high enough to permit positioning a section of drill pipe under the coupling member 187 for connection thereto. The sling 136 will be connected to a section of drill pipe in the manner shown in FIG. 15 and the auxiliary hoist cable 124 will be connected to the sling and operated to raise the drill pipe from its stored position in the tray 36 to a substantially vertical hanging position. The actuator 156 will then be operated to swing the positioning mechanism 150 into position whereby the jaws 164 may be operated to close and grip the section of drill pipe hanging from the hoist cable 124. When the positioning mechanism 150 has clamped the pipe section of drill tightly tension on the hoist cable 124 is released and the positioning mechanism is swung into position wherein the section of pipe is directly beneath or aligned with the coupling member 187, as shown in FIG. 16. The head 50 is then lowered and the drive unit 180 is rotated to threadedly couple the section of pipe to the coupling member 187. The head 50 is normally lowered sufficiently to telescope the members 189 and 191 with respect to each other upon engagement of the top end of the pipe so that during the screwing-in operation the cooperating threads will not be damaged.

When a section of pipe is firmly connected to the head 50 as above described the jaws of the positioning mechanism 150 are released and the positioning mechanism is swung to a retracted position such as the position shown by the solid lines in FIG. 5. The sling 136 is also then removed from the lower end of the section of pipe. If the above described operation is that of connecting the first section of pipe to the head 50 then prior to lowering the pipe the bushing 224 is placed in a socket 205 in the deck 204 and a bit sub 41, FIG. 1, is supported therein by the wrench 234. The bit sub 41 may be provided with recesses similar to the recesses 139 on the pipe section 138. The pipe is then lowered by the head 50, the drive unit 180 is rotated to threadedly couple the lower end of the pipe to the bit sub 41, and the head and drive unit are then raised slightly to permit removal of the wrench 234. Drilling is then commenced and the head and drive unit 180 are pulled down by the cylinders 72 and associated feed chains while the drill string is rotated by the drive unit.

When the top end of a section of drill pipe reaches the bushing 224, disposed on the deck 204, drilling is stopped and the wrench 234 is inserted in the recesses 139 on the section of drill pipe to hold the drill string against rotation. The drive unit 180 is operated to rotate the sub 56 and coupling 187 in a direction to disconnect from the drill string as shown in FIG. 17 and the head and drive unit 180 are then raised up the mast to a position for receiving another section of drill pipe from the positioning mechanism 150 in the manner described herein and as shown in FIG. 16. A section of drill pipe may be placed in the positioning mechanism 150 while drilling is being conducted to thereby be waiting in readiness, as shown in FIG. 1, for addition to the drill string when needed. When another section of drill pipe is connected to the head 50 it is lowered and coupled to the section of pipe held against rotation by the wrench 234. The wrench 234 is then removed and drilling resumed. The process of adding sectional drill pipe members as described is repeated until the desired hole depth is reached.

Upon completion of the drill hole or if withdrawal of the drill string or a portion thereof is desired the drill string may be hoisted from the hole by being left connected to the head 50 and using the pulldown cylinders 72 to raise the drill string out of the hole. If the head 50 is used to hoist the drill string the drive unit 180 will remain coupled to the head and the procedure will be to raise the head 50 up the mast until the top end of the section of drill pipe which is connected to the section coupled to the head is in position to be held in the bushing 224 by insertion of the wrench 234.

With the wrench 234 holding the drill string nonrotatably and to prevent the drill string from dropping back into the drill hole the drive unit 180 may be rotated to unscrew the section of pipe connected to the head 50 from the section of pipe retained in the bushing 224. If the threaded connection between the coupling 187 and the section of drill pipe connected thereto should become loose, rather than the threaded connection between the two sections, the breakout wrench 210 may be clamped to the drill section of pipe connected to the head and the cylinder 218 can then be actuated to break loose the connection between the two sections of pipe.

When the uppermost section of drill pipe is disconnected from the drill string the head 50 is raised slightly to permit the sling 136 to be attached to the section of drill pipe in the manner shown in FIG. 1. The sleeve 146 is positioned on the cable 140 and suitably clamped to prevent sliding toward the hook 148 and so as to be in proper position for handling the section of drill pipe. With the section of drill pipe still connected to the head 50 the positioning mechanism 150 is moved into position for the jaws 162–164 on each arm 158 to be actuated to clamp the section of pipe non-rotatably while the drive unit 180 is then operated to unscrew the coupling 187 from the section. The section of drill pipe now being completely disconnected, may be moved by the positioning mechanism 150 and then the auxiliary hoist to the storage tray 36. The head 50 is then lowered to be connected to the top of the drill string and the process above described is repeated for each section of drill pipe to be removed.

The process of removing the bit 40 together with the bit sub 41 from the drill string comprises raising the head 50 until the bit sub is in position to be held by the wrench 234 in the bushing 224. The section of drill pipe connected to the bit sub 41 is unscrewed therefrom using the drive unit 180 to rotate the drill pipe. The auxiliary hoist cable 124 may be suitably attached to the bit sub 41 after the sub has been disconnected from the drill string and the sub together with the bit and bushing 224 may be removed from the rig by the auxiliary hoist.

Relatively deep holes, which may be drilled with the drill rig 20, will require a long drill string the removal of which from the drill hole requires the disconnection and handling of many sections of drill pipe. The drill rig 20 provides for disconnection and handling of the individual sections of drill pipe in a rapid and easy manner.

When it is desired to remove a long drill string from the drill hole the head 50 and rotary drive unit 180 will be operated to drill with the drill string until the drive unit is just above the deck 204. Then the bushing 224 will be removed from the socket 205 and drilling will resume until the drive unit 180 engages the deck 204. With the drive unit 180 situated on the deck 204, as shown in FIG. 18, the pins 202 will be removed from the members 66 and the head 50 will be raised up to disengage the collar 188 from the recess 186 in the drive member 184 and also just high enough to place the recesses 139 on the uppermost section of pipe in position to be held by the wrench 234. As shown in FIG. 18 the bushing 224 is placed in the recess 186 on the drive unit 180 and the wrench 234 is inserted to hold the top end of the drill string in the drive unit 180. The breakout wrench 210 is clamped on the sub 56 and the rotary drive unit 180 is then operated to rotate the drill string to disconnect the head from the drill string. When the threaded connection between the coupling member 187 and the drill string is broken the breakout wrench 210 is released and the head 50 is then raised up the mast and into the parked position as shown in FIGS. 4, 9, and 19.

With the head 50 retracted to provide clearance along the drilling axis 123 of the drill string the winch 118 is operated to lower the block 108 and the threaded plug 122 is screwed into the top end of the section of pipe held in the drive unit 180. The winch 118 is then operated to hoist the drill string slightly followed by removal of the wrench 234 and then the drill string is hoisted until the recesses 139 in the next lower section of drill pipe are in position just above the bushing 224 whereby the wrench 234 may be reinserted to hold the drill string again. As shown in FIG. 19 the breakout wrench 210 is clamped to a section of pipe 38 and the drive unit 180 is operated to rotate the drill string while the section of pipe 38 is held stationary by the wrench 210. If the drive unit 180 cannot exert enough torque to break loose the threaded connection between sections of drill pipe, the extension arm 237 may be inserted over the end of the handle 235 on the wrench 234 and the drive unit 180 is then rotated to engage the arm with one of the side members 42 of the mast 30. The wrench 210 can then be actuated to break loose the connection by operation of the cylinder 218. With a section of drill pipe 38 disconnected from the drill string the winch 118 may be operated to lower the section of pipe into the tray 36 with assistance from the rig operating personnel. The plug 122 is removed from the stored section of pipe and connected to the upper end of the drill string to perform the operation of removing the next section of pipe by substantially repeating the steps described above.

As may be appreciated from the foregoing the removal and storage of sectional drill pipe members may be easily and rapidly carried out with the operation of the rig 20 as described wherein the drive unit 180 is disposed on the deck 204 and the head 50 is parked in a retracted position to provide for use of the block 108 to handle the individual sections of drill pipe.

It will also be appreciated by those skilled in the art of rotary drilling that, if desired, the drive unit 180 may be disposed on the deck 204 and used as a so-called rotary table type drive. In such operation a conventional polygonal cross section elongated drive member or kelly can be connected to the head 50, and a cooperating drive bushing suitable for rotating the kelly may be disposed in the recess 186 in the drive member 184. Moreover, there is a need to drive large tube or casing into a drill hole as it is being formed or once the hole is completed and before the rig is removed from the drilling site. Thanks to the relatively large bore 185 formed in the drive member 184 the drive unit 180 may be left on the deck 204 and the casing passed through the drive member while being axially driven by the head 50. Suitable means adapted to engage the upper end of a section of casing could be used on the head 50 in place of the coupling member 187.

What is claimed is:

1. A rotary drill rig comprising:

an elongated upstanding mast;

a head disposed on said mast for linear traversal along said mast;

coupling means rotatably mounted on said head for releasably coupling said head to one end of an elongated sectional drilling member comprising the upper end of a drill string;

a pulldown mechanism disposed on said mast and connected to said head and operable to exert pulldown and hoisting movements on said head and said drill string;

a rotary drive unit disposed for linear traversal along said mast;

means interconnecting said rotary drive unit and said pulldown mechanism whereby said rotary drive unit is operable to traverse said mast with said head in response to the operation of said pulldown mechanism;

means for supporting said rotary drive unit at the lower end of said mast and independent of the operation of said pulldown mechanism; and, means forming a drive connection between said rotary drive unit and said drill string for rotatably driving said drill string when said rotary drive unit is operating to traverse said mast with said head.

2. The invention set forth in claim 1 wherein:

said mast includes a pair of spaced apart tracks running longitudinally along said mast, and said head includes guide means engageable with said tracks for guiding said head along said mast substantially in alignment with the drilling axis of said drill string.

3. The invention set forth in claim 2 wherein:

said rotary drive unit includes guide means thereon and engageable with said tracks for guiding said rotary drive unit to maintain said rotary drive unit substantially in alignment with the drilling axis of said drill string.

4. The invention set forth in claim 2 wherein:

said tracks include first portions which are disposed at an angle with respect to second portions of said tracks which run longitudinally along said mast, and said pulldown mechanism is operable to move said head onto said first portions of said tracks to place said head out of alignment with said drilling axis.

5. The invention set forth in claim 4 wherein:

said pulldown mechanism includes flexible chain means connected to said head and to tensioning means mounted on said mast.

6. The invention set forth in claim 5 wherein:

said tensioning means include members for yieldably tensioning said chain means to allow for a change in chain path length when said head is moved onto said first portions of said tracks.

7. The invention set forth in claim 4 wherein:

said drill rig includes means disposed on said mast for connection to said drill string for hoisting said drill string up said mast when said head is disposed on said first portions of said tracks.

8. The invention set forth in claim 7 wherein:

said means for hoisting said drill string includes flexible cable means connected to power winch means and disposed on said mast for raising and lowering said drill string substantially along the drilling axis of said drill string.

9. The invention set forth in claim 2 together with:

a positioning mechanism disposed on said mast and including means for holding a sectional drilling member, said positioning mechanism being adapted to move between a first position where a sectional drilling member held therein is substantially in alignment with said drilling axis and a retracted position where a sectional drilling member may be placed in or removed from said positioning mechanism.

10. The invention set forth in claim 9 wherein:

said positioning mechanism includes a pair of spaced apart arms mounted on said mast for pivotal movement about an axis substantially parallel to said drilling axis, said arms including movable jaws for releasably gripping a sectional drilling member.

11. The invention set forth in claim 10 wherein:

said arms each include pressure fluid cylinder actuators for actuating said movable jaws to grip a sectional drilling member, said actuators including movable members for urging said jaws to a gripping position, and spring means disposed for engagement with said movable members and said jaws urging said jaws to the gripping position.

12. The invention set forth in claim 9 together with:

auxiliary hoisting means disposed on said mast and operable to be connected to a sectional drilling member for placing said drilling member in position to be held by said positioning mechanism in said retracted position of said positioning mechanism.

13. The invention set forth in claim 1 wherein:

said rotary drive unit includes a drive member rotatably mounted on said drive unit and including a bore through which said drill string projects, and said means forming a drive connection between said rotary drive unit and said drill string includes a member adapted to be releasably connected to said drive member whereby said drive member may rotatably drive said drill string through said coupling means.

14. The invention set forth in claim 13 wherein:

said drive member includes a recess formed therein and cooperate with a collar disposed on said head and drivably connected to said coupling means, said collar being adapted to be disposed in said recess in driven engagement with said drive member.

15. The invention set forth in claim 14 wherein:

said rotary drive unit includes a motor mounted thereon and drivably engaged with said drive member.

16. The invention set forth in claim 13 together with:

means engageable with said drive member and adapted to drivably connect said rotary drive unit to said drill string when said rotary drive unit is disposed at the lower end of said mast.

17. The invention set forth in claim 16 wherein:

said means engageable with said drive member comprises a bushing adapted to fit in a recess in said drive member, and a holding wrench cooperable with said bushing and a sectional drilling member whereby said drill string may be rotated in response to rotation of said drive member.

18. The invention set forth in claim 17 together with:

wrench means disposed on said mast and operable to be engaged with a sectional drilling member for holding said drilling member nonrotatably when said drill string is rotated by said rotary drive unit.

19. The invention set forth in claim 1 wherein:

said pulldown mechanism includes a pair of elongated members spaced apart in side-by-side relationship on said mast and operable to linearly traverse said mast, and said means interconnecting said rotary drive unit and pulldown mechanism includes a pair of pins removably engageable with said rotary drive unit and said elongated members.

20. A rotary drill rig comprising:

an elongated upstanding mast;

a head disposed on said mast for linear traversal along said mast;

coupling means rotatably mounted on said head for releasably coupling said head to one end of an elongated sectional drilling member comprising the upper end of a drill string;

a pulldown mechanism disposed on said mast and connected to said head and operable to exert pulldown and hoisting movements on said head and said drill string;

a rotary drive unit;

means for releasably interconnecting said rotary drive unit and said pulldown mechanism whereby said rotary drive unit is operable to traverse said mast with said head in response to the operation of said pulldown mechanism; and, means forming a drive connection between said rotary drive unit and said drill string for rotatably driving said drill string when said rotary drive unit is operating to traverse said mast with said head.

* * * * *